US009261062B2

(12) United States Patent
Johnson et al.

(10) Patent No.: US 9,261,062 B2
(45) Date of Patent: Feb. 16, 2016

(54) SQUEEZE CLIP GROUND STRAP

(71) Applicant: GM Global Technology Operations LLC, Detroit, MI (US)

(72) Inventors: Timothy J. Johnson, Clarkston, MI (US); David A. Wulbrecht, Clarkston, MI (US); Jonathan Pung, Auburn Hills, MI (US); Christopher K. Clarke, Commerce Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 303 days.

(21) Appl. No.: 13/828,321

(22) Filed: Mar. 14, 2013

(65) Prior Publication Data

US 2013/0291837 A1 Nov. 7, 2013

Related U.S. Application Data

(60) Provisional application No. 61/642,328, filed on May 3, 2012.

(51) Int. Cl.

| | |
|---|---|
| ***F02M 35/10*** | (2006.01) |
| ***F02M 63/00*** | (2006.01) |
| ***F02M 51/00*** | (2006.01) |
| ***F02M 55/02*** | (2006.01) |

(52) U.S. Cl.

CPC ..... *F02M 63/00* (2013.01); *F02M 35/10078* (2013.01); *F02M 35/10216* (2013.01); *F02M 35/10249* (2013.01); *F02M 35/10321* (2013.01);

(Continued)

(58) Field of Classification Search

CPC ..... F16L 9/125; F16L 11/127; F16L 25/01; F16L 3/2235; F16L 9/133; F02M 35/10249; F02M 35/10321; F02M 37/0017; F02M 51/005; F02M 55/025; F02M 63/00; F02M 35/10078; F02M 35/10216; F02M 61/14; F02M 2051/08; F02M 69/043; F02M 69/465; H01T 13/06; H01T 13/04; B05B 5/1691; B05B 5/0255; B05B 5/043; B05B 5/0533; B05B 5/032; B05B 5/03

USPC ..... 123/143 C, 470, 472, 456; 239/690, 239/690.1, 695, 704

See application file for complete search history.

(56) References Cited

U.S. PATENT DOCUMENTS

| | | | | |
|---|---|---|---|---|
| 4,651,701 | A * | 3/1987 | Weaver | 123/509 |
| 4,903,645 | A * | 2/1990 | Borger | 123/184.61 |
| 6,186,106 | B1 * | 2/2001 | Glovatsky et al. | 123/143 C |

(Continued)

*Primary Examiner* — Hung Q Nguyen
*Assistant Examiner* — Brian P Monahon
(74) *Attorney, Agent, or Firm* — Ingrassia Fisher & Lorenz, P.C.

(57) ABSTRACT

Vehicles and engines are provided. The engine, for example, may include a first engine component configured to be ohmically coupled to a common ground, a second engine component configured to be coupled to the first engine component, the second engine component comprising an insulative materially ohmically isolating the second engine component from the first engine component, the second engine component including an inclusion having a predetermined depth along a surface of the second engine component configured to be coupled to the first engine component, a third engine component configured to be coupled to the second engine component, and a spring clip configured to be ohmically coupled to the third engine component, wherein the spring clip is further configured to be disposed within the inclusion of the second engine component and to have a deflectable surface having an undeflected depth greater than the predetermined depth of the inclusion.

13 Claims, 6 Drawing Sheets

(52) U.S. Cl.
CPC ..... *F02M 51/005* (2013.01); *F02M 55/025* (2013.01)

(56) References Cited

U.S. PATENT DOCUMENTS 6,474,573 B1 * 11/2002 Kelly ..... 239/690
6,776,185 B2 * 8/2004 Farrar et al. ..... 137/560
8,172,556 B2 * 5/2012 Malec et al. ..... 417/423.15
2002/0124833 A1 * 9/2002 Fauser et al. ..... 123/509
2003/0101971 A1 * 6/2003 Farrar et al. ..... 123/510
2005/0051138 A1 * 3/2005 Haley et al. ..... 123/468
2005/0166882 A1 * 8/2005 Suzuki et al. ..... 123/143 C
2007/0108765 A1 * 5/2007 Hayakawa ..... 285/347
2009/0230674 A1 * 9/2009 Villaire et al. ..... 285/179

* cited by examiner

SQUEEZE CLIP GROUND STRAP

CROSS REFERENCE TO RELATED APPLICATIONS

This application claims the benefit of U.S. Provisional Application No. 61/642,328, filed May 3, 2012, which is incorporated herein by reference.

TECHNICAL FIELD

The technical field generally relates to grounding of automotive components, and more particularly relates to ground straps.

BACKGROUND

Fuel rails are used to deliver fuel to individual fuel injectors on internal combustion engines. Fuel rails for, for example, port fuel injection (PFI) engines are often coupled to an intake manifold. Fuel rails are designed to have a pocket or seat for each injector as well as an inlet for a fuel supply. Some fuel rails also incorporate an attached fuel pressure regulator. Fuel rails are used on engines with multi-point fuel injection systems, although some multi-point systems use a fuel distributor with individual pipes or tubes to feed each injector. Fuel rails are generally coupled to an intake manifold, which is the part of an engine that supplies the fuel/air mixture to the cylinders. Fuel rails need to be grounded. However, intake manifolds are generally made of plastic, which electrically isolates the fuel rail from a common vehicle ground.

Traditionally, a bolt is used to couple the intake manifold to a grounded cylinder head. A ground plate, which is ohmically connected to the fuel rail, is generally secured by the bolt to the intake manifold. Accordingly, the bolt ohmically couples the cylinder head to the ground plate. However, the ground plate can interfere with the secure coupling of the bolt, potentially causing the intake manifold to loosen from the cylinder head and causing the fuel rail to again become electrically isolated from the vehicle common ground.

Accordingly, it is desirable to securely ground the fuel rail while securely coupling the intake manifold to the cylinder head. Furthermore, other desirable features and characteristics of the present invention will become apparent from the subsequent detailed description and the appended claims, taken in conjunction with the accompanying drawings and the foregoing technical field and background.

SUMMARY

An engine is provided. In an exemplary embodiment, the engine may include, but is not limited to, a first engine component configured to be ohmically coupled to a common ground, a second engine component configured to be coupled to the first engine component, the second engine component comprising an insulative material ohmically isolating the second engine component from the first engine component, the second engine component including having a predetermined depth along a surface of the second engine component configured to be coupled to the first engine component, a third engine component configured to be coupled to the second engine component, and a spring clip configured to be ohmically coupled to the third engine component, wherein the spring clip is further configured to be disposed within the inclusion of the second engine component and to have a deflectable surface having an undeflected depth greater than the predetermined depth of the inclusion.

A vehicle is provided. The vehicle may include, but is not limited to, an engine including a first engine component configured to be ohmically coupled to a common ground, a second engine component configured to be coupled to the first engine component, the second engine component comprising an insulative material ohmically isolating the second engine component from the first engine component, the second engine component including an inclusion having a predetermined depth along a surface of the second engine component configured to be coupled to the first engine component, a third engine component configured to be coupled to the second engine component, and a spring clip configured to be ohmically coupled to the third engine component, wherein the spring clip is further configured to be disposed within the inclusion of the second engine component and to have a deflectable surface having an undeflected depth greater than the predetermined depth of the inclusion An engine is provided. The engine may include, but is not limited to at least one cylinder head configured to be ohmically coupled to a common ground, an intake manifold configured to be coupled to the at least one cylinder head, the intake manifold comprising an insulative material ohmically isolating the intake manifold from the least one cylinder head, the intake manifold including an inclusion having a predetermined depth along a surface of the intake manifold configured to be coupled to the least one cylinder head, a fuel rail configured to be coupled to the intake manifold, and a spring clip configured to be ohmically coupled to the fuel rail, wherein the spring clip is further configured to be disposed within the inclusion of the intake manifold and to have a deflectable surface having an undeflected depth greater than the predetermined depth of the inclusion.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description.

Figure 1:
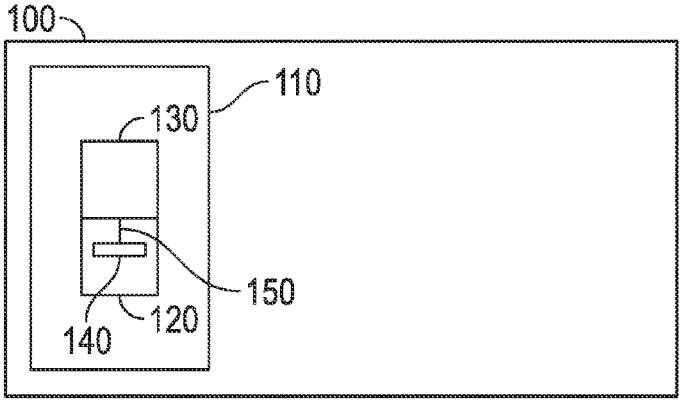
FIG. 1 is a block diagram of a vehicle having an engine in accordance with an embodiment.

FIG. 1 is a block diagram of a vehicle 100 having an engine 110 in accordance with an embodiment. The vehicle 100 may be an automobile, a watercraft, an aircraft, or any other type of vehicle with an internal combustion engine. The engine may be a diesel engines, HCCI engines, hydrogen fuel cell engines, steam engines, 2-stroke engines, hybrid technology engines, DI IC Engines, PFI IC engines, or any other type of engines, electric motors, or general assemblies that require a serviceable or non-serviceable electrostatic ground of any kind.

The engine 110 includes an intake manifold 120 and at least one cylinder head 130. The primary function of the intake manifold 120 is to distribute the combustion mixture (or just air in a direct injection engine) to an intake port for each cylinder head 130 in the engine 110. The intake manifold 120 may also serve as a mount for one or more other engine components 140. The one or more other engine components may be, for example, a carburetor, a throttle body, a fuel rail and/or fuel injectors. Other engines components that could be grounded as discussed herein include, but are not limited to, an intake air heater, electronic actuators of any kind (intake manifold tuning valves, swirls valves, variable intake manifold valves, or the like), sensors of any kind (pressure, temperature, WIF (water in fuel), humidity, or the like), exhaust recirculation gases (EGR) temperature sensors, or EGR valves.

In one embodiment, for example, the intake manifold 120 may be constructed from plastic. However, in other embodiments the intake manifold 120 may be constructed from another insulating material. Accordingly, the engine components 140 coupled to the intake manifold 120 are electrically isolated from the vehicle common ground. However, the intake manifold 120 is configured to be coupled to the cylinder head 130. The cylinder head is generally conductive and is coupled to the common ground for the vehicle. Accordingly, as discussed in further detail below, a ground strap 150 is used to ohmically connect the engine components 140 mounted on the intake manifold 120 to the cylinder head 130. In another embodiment, for example, the ground strap 150 may be ohmically coupled to an engine block, an oil pan, an exhaust manifold or a vehicle frame or body.

Figure 2:
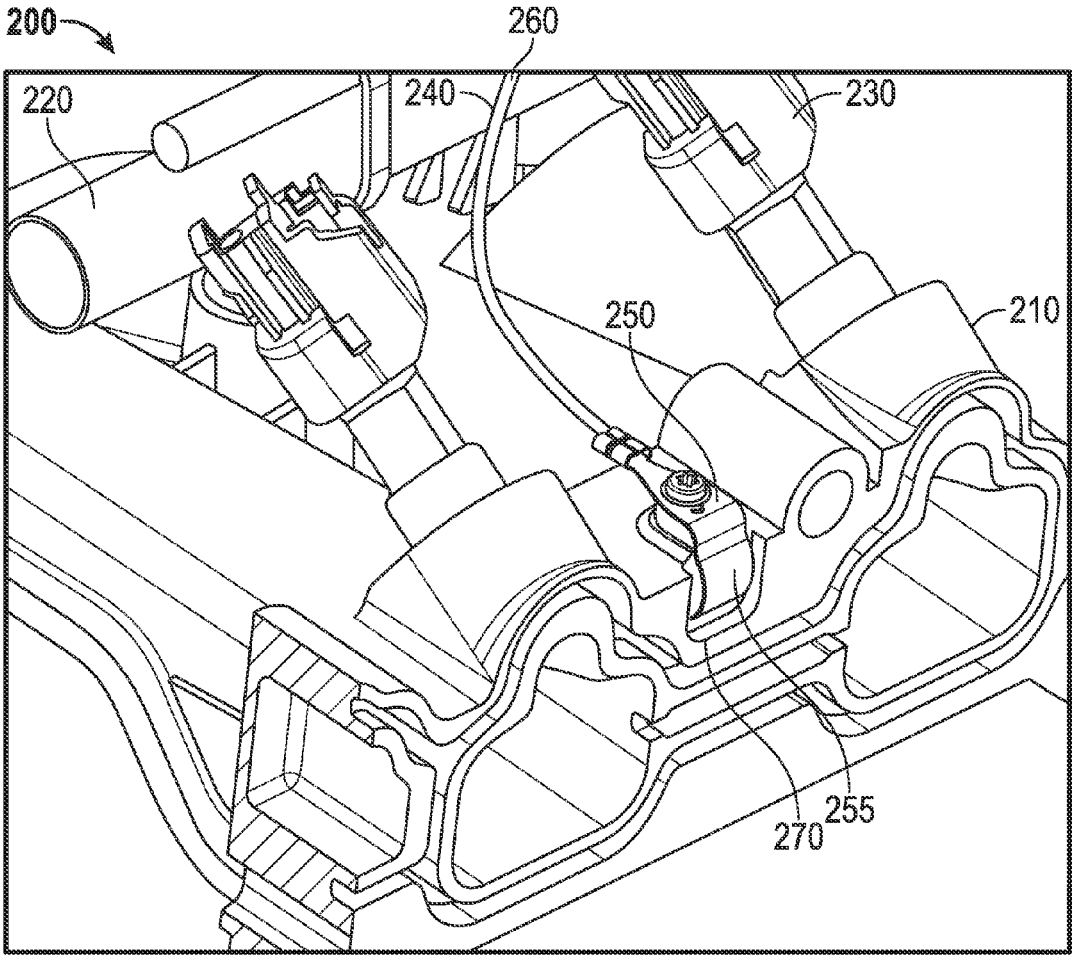
FIG. 2 is a perspective view of an engine, in accordance with an embodiment.

FIG. 2 is a perspective view of an engine 200, in accordance with an embodiment. The engine 200 includes an intake manifold 210 and a fuel rail 220. The fuel rail 220 delivers fuel to the engine 200 through a fuel injection system 230. As seen in FIG. 2, the fuel rail 220 is one of the components mounted on the intake manifold 210. Thus, the fuel rail 220 could be subject to static buildup since the fuel rail 220 is electrically isolated from the vehicle common ground. As the fuel rail 220 transports a combustible material, the fuel rail 220 must be grounded for safety. In order to ground the fuel rail 220, a ground strap 240 is used to ohmically connect the fuel rail 220 a cylinder head, as discussed in further detail below.

The ground strap 240 illustrated in FIG. 2 includes a spring clip 250. The spring clip 250 is configured to be coupled to the intake manifold 210. In the embodiment illustrated in FIG. 2, for example, the spring clip 250 is coupled to the intake manifold 210 via a fastener, such as a screw or a bolt. In other embodiments, for example, the spring clip 250 may be friction fit to the intake manifold or held in place by other means, as discussed in further details below. The spring clip 250 is ohmically coupled to the fuel rail 220 via a wire 260. In one embodiment, for example, the wire 260 may be welded or soldered to the fuel rail 220 and the spring clip 250, however any other method for ohmically coupling the wire 260 to the fuel rail 220 and spring clip 250 may be used.

The intake manifold 210 includes an inclusion 270 on a surface of the intake manifold 210 that couples to a cylinder head. The inclusion 270 extends into the intake manifold by a predetermined distance. The spring clip 250 includes a flexible protrusion 255 having a deflectable surface which is configured to be inserted into the inclusion 270 of the intake manifold 210. In this embodiment, for example, the flexible protrusion 255 has an arched surface. In one embodiment, for example, the spring clip 250 may be manufactured from any spring steel that is conductive and would retain spring load against a ground component. The width of the protrusion 255 of the spring clip 250 configured to be inserted into the inclusion 270 is greater than the depth of the inclusion 270, such that the protrusion of the spring clip 250 is pressed against a cylinder head when the intake manifold is coupled 210 to the cylinder head.

Figure 3:
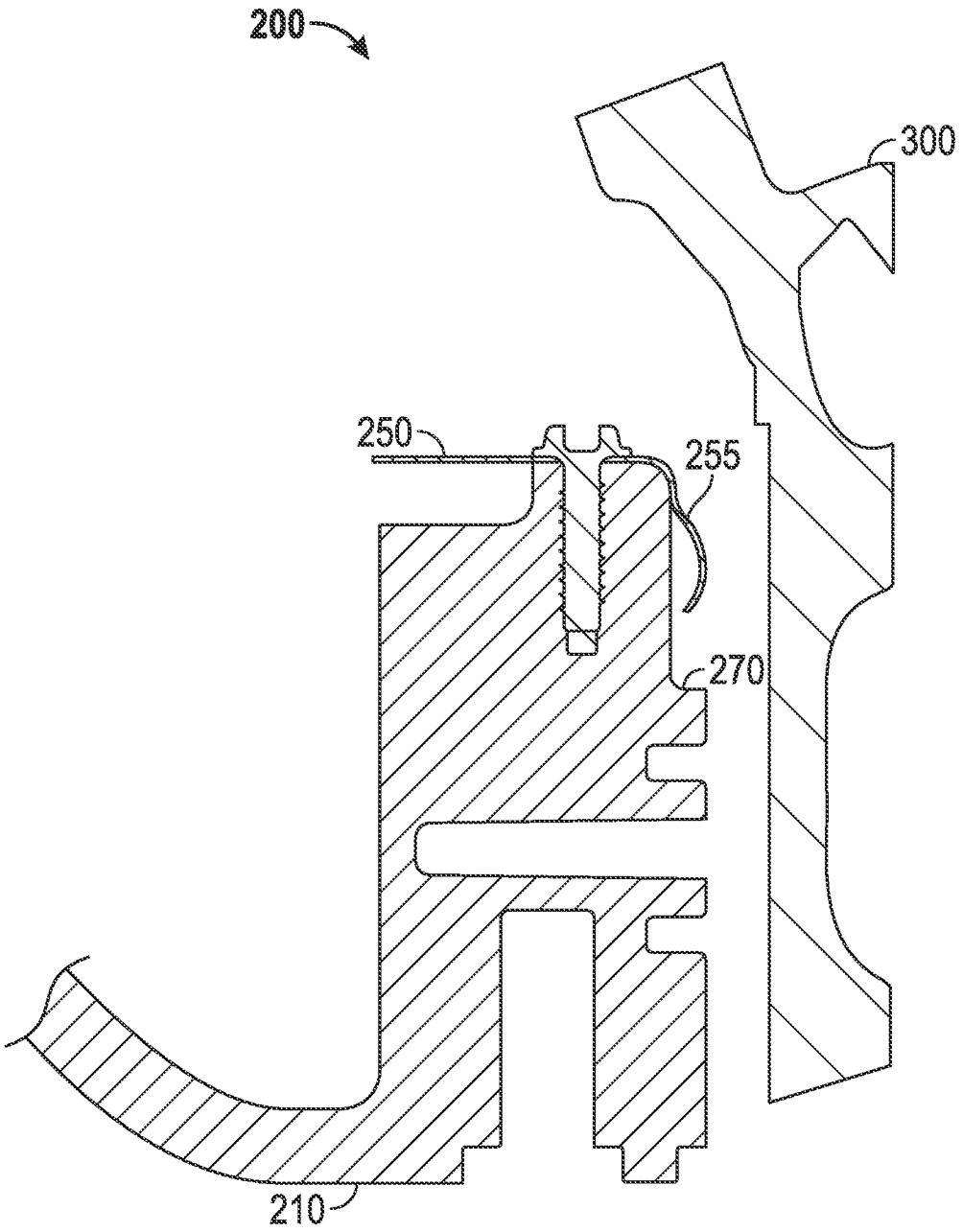
FIG. 3 is a side view of the engine illustrated in FIG. 2, in accordance with an embodiment.

FIG. 3 illustrates a side view of the engine 200 illustrated in FIG. 2. As seen in FIG. 3, the surface of the intake manifold 210 is configured to be coupled to a surface of a cylinder head 300. The spring clip 250 includes a protrusion 255 configured to be placed in the inclusion 270 in the intake manifold 210. The protrusion 255 of the spring clip 250 is of sufficient size to extend beyond the surface of the intake manifold 210 when the intake manifold 210 is not coupled to the cylinder head 300 to ensure that the spring clip 250 is ohmically coupled to the cylinder head 300. Further, the protrusion of the spring clip 250 is configured to be flexible so as to not impede the coupling of the intake manifold 210 to the cylinder head 300. As seen in FIG. 3, a length of the inclusion 270 in the intake manifold 210 is also greater than a length of the spring clip 250. Accordingly, as the spring clip 250 flexes when the intake manifold 210 is coupled to the cylinder head 300, the spring clip 250 expands into the open area, preventing strain on the spring clip 250.

Figure 4:
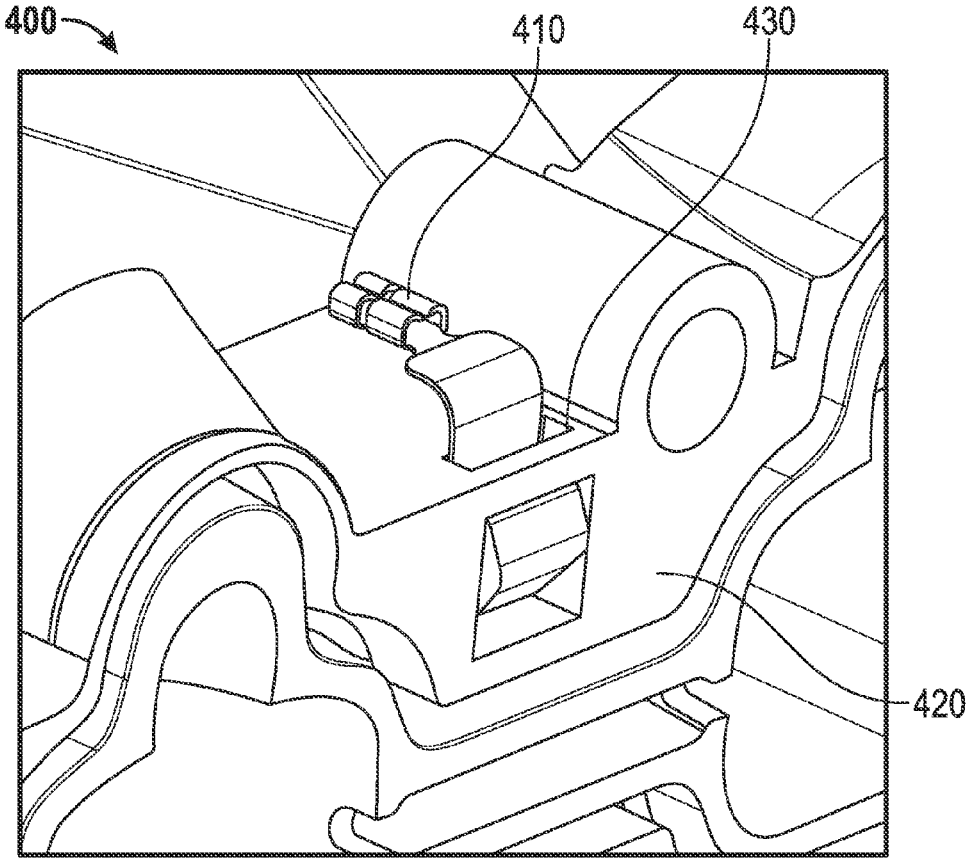
FIG. 4 is a perspective view of another exemplary intake manifold and spring clip, in accordance with an embodiment.
Figure 5:
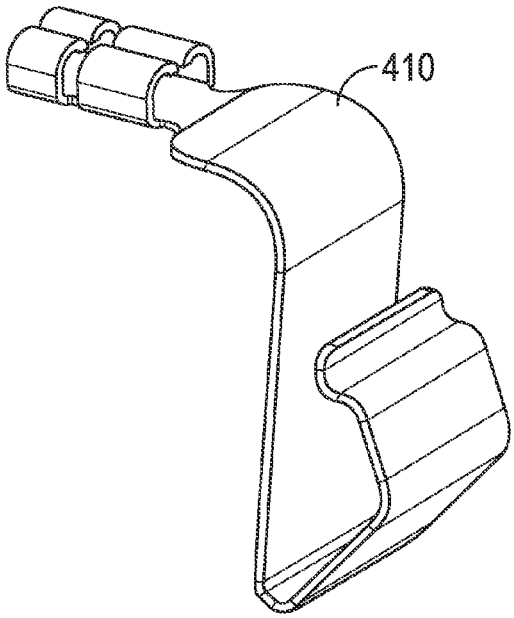
FIG. 5 is a perspective view of the spring clip illustrated in FIG. 4, in accordance with an embodiment.

FIG. 4 is a perspective view of another exemplary intake manifold 400 and spring clip 410, in accordance with an embodiment. FIG. 5 is a perspective view of the spring clip illustrated in FIG. 4, in accordance with an embodiment. The intake manifold 400 includes an inclusion 420 on the surface of the intake manifold that is to be coupled to a cylinder head. The intake manifold 400 also includes an inclusion 430 along a top surface. The inclusion 420 on the surface of the intake manifold that is to be coupled to a cylinder head and the inclusion 430 along a top surface of the intake manifold 400 are connected such that a spring clip 410 inserted in the inclusion 430 along a top surface of the intake manifold 400 can extend past the inclusion 420 on the surface of the intake manifold that is to be coupled to a cylinder head.

The spring clip 410 is configured to be inserted into the inclusion 430 along the top surface of the intake manifold and to lock into the inclusions 420 and 430. The spring clip is removable by pressing on the surface of the spring clip 410 that extends beyond the surface of the intake manifold that couples to a cylinder head such that the various components can be serviced, if necessary.

Figure 6:
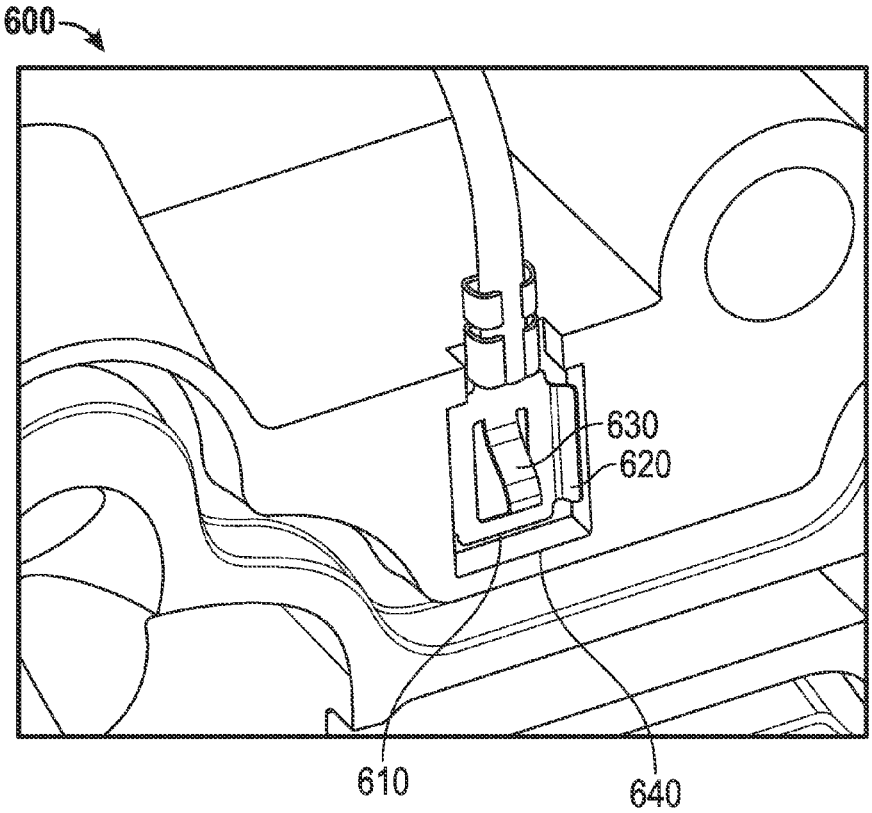
FIG. 6 is a perspective view of another exemplary intake manifold and spring clip, in accordance with an embodiment.

FIG. 6 is a perspective view of another exemplary intake manifold 600 and spring clip 610, in accordance with an embodiment. The spring clip 610 includes an outer portion 620 and an inner portion 630. The inner portion 620 is configured to extend beyond a surface of an intake manifold 600 and deflect, to ohmically couple an engine component to a cylinder head without impeding the coupling of the intake manifold 600 to the cylinder head. The intake manifold 600 includes an inclusion 640. The inclusion has a first width along a top surface of the intake manifold and a second wider width along a surface of the intake manifold 600 configured to be coupled to a cylinder head. The outer portion 620 of the spring clip 610 is configured to be larger than the width of inclusion 640 along the top surface of the intake manifold to keep the spring clip in place when the intake manifold is coupled to the cylinder head.

Figure 7:
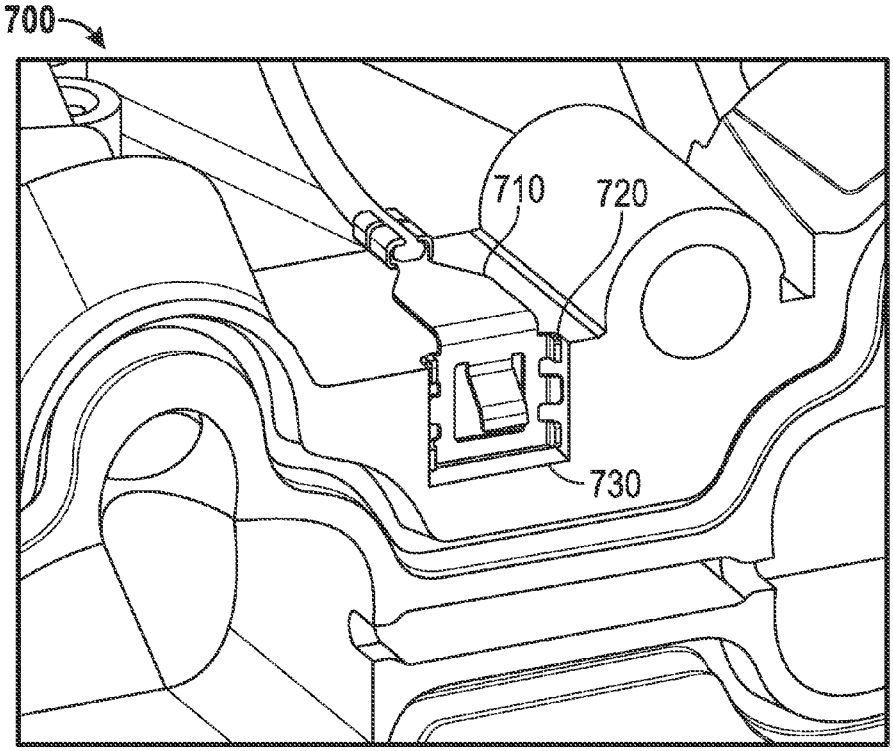
FIG. 7 is a perspective view of yet another exemplary intake manifold and spring clip, in accordance with an embodiment.

FIG. 7 is a perspective view of yet another exemplary intake manifold 700 and spring clip 710, in accordance with an embodiment. The spring clip 710 includes a series of protrusions 720 along an outer surface of the spring clip 710. The spring clip 710 is wider than an inclusion 730 in the intake manifold 700. The protrusions 720 along an outer surface of the spring clip 710 are flexible. Accordingly, when the spring clip 710 is inserted into the inclusion 730, the friction of the protrusions on the surface of the inclusion help keep the spring clip 710 in place.

Figure 8:
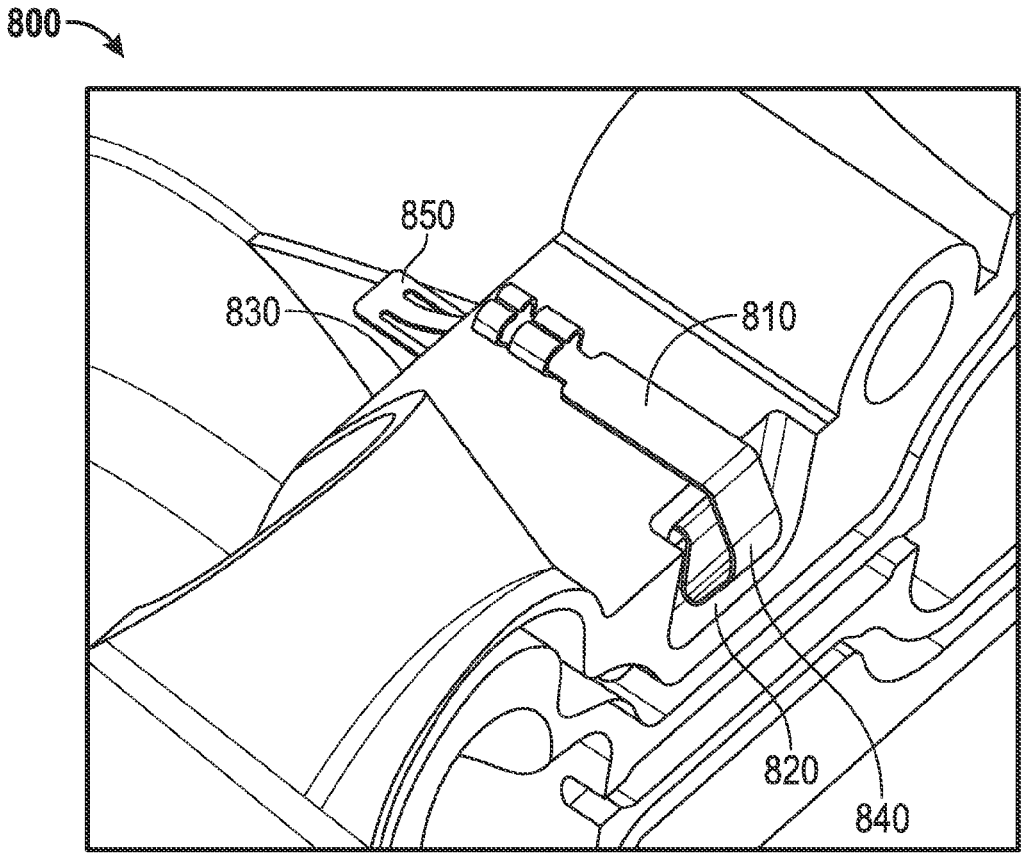
FIG. 8 is a perspective view of another exemplary intake manifold and spring clip, in accordance with an embodiment.
Figure 9:
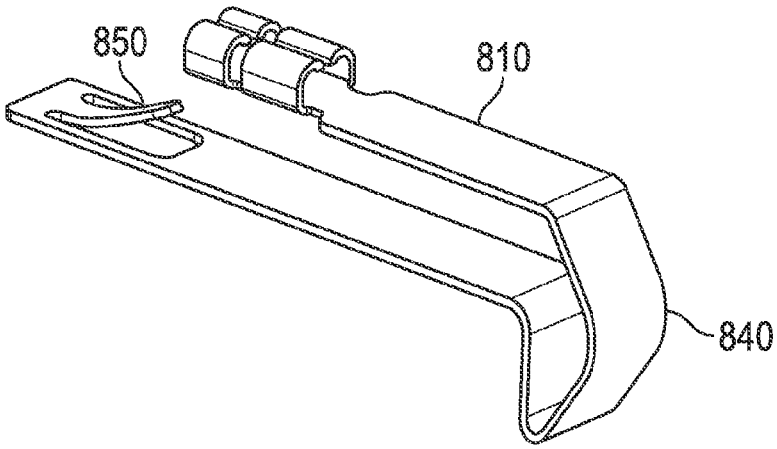
FIG. 9 is a perspective view of the spring clip illustrated in FIG. 8, in accordance with an embodiment.

FIG. 8 is a perspective view of another exemplary intake manifold 800 and spring clip 810, in accordance with an embodiment. FIG. 9 is a perspective view of the spring clip 810 illustrated in FIG. 8, in accordance with an embodiment. As seen in FIG. 8, the intake manifold 800 includes an inclusion 820 along the surface to be coupled to a cylinder head while also allowing a portion of the spring clip 810 to be inserted into the intake manifold 800 and pass thru to a second side 830 of the intake manifold 800. The spring clip 810 includes two deflectable portions. The first portion 840 is configured to extend beyond a surface of the intake manifold 800 in a similar manner discussed above. The second deflectable portion 850 is configured to be displaced when being inserted into the inclusion of the intake manifold 800, and to expand upon exiting to the second side 830 of the intake manifold 800, to lock the spring clip 810 into place.

Figure 10:
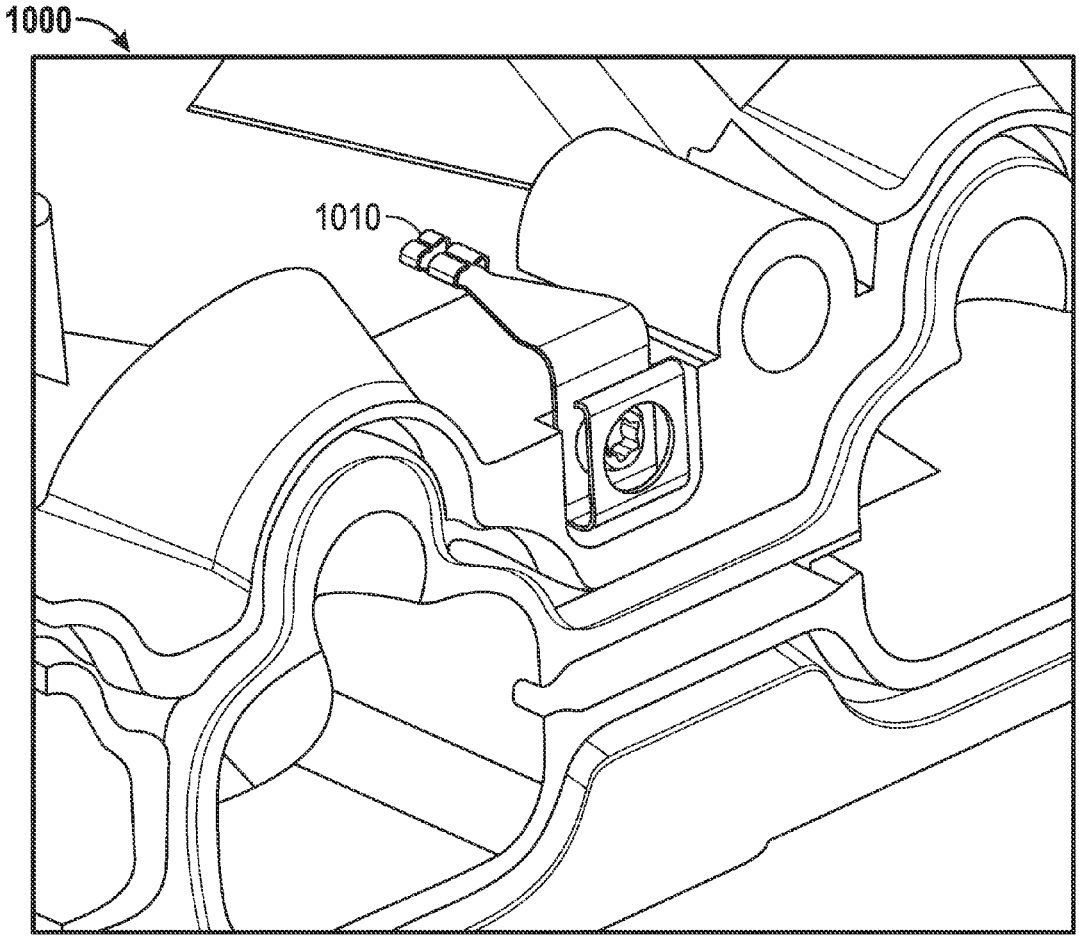
FIG. 10 is a perspective view of another exemplary intake manifold and spring clip, in accordance with an embodiment.
Figure 11:
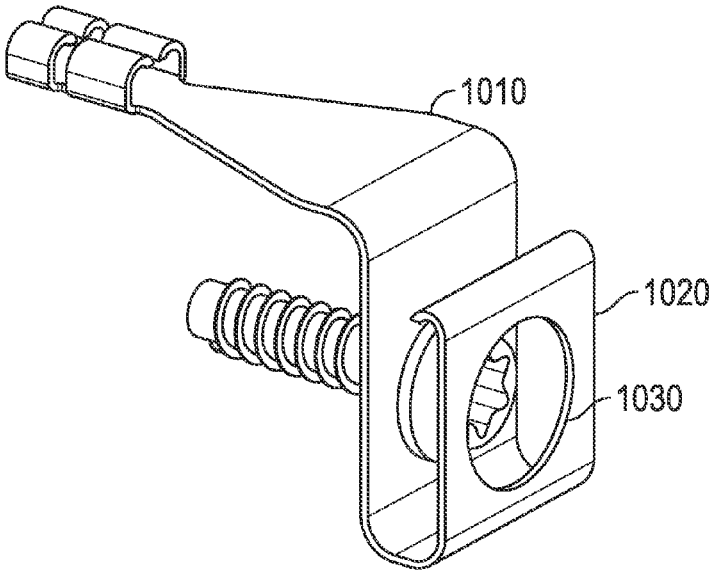
FIG. 11 is a perspective view of the spring clip illustrated in FIG. 10, in accordance with an embodiment.

FIG. 10 is a perspective view of another exemplary intake manifold 1000 and spring clip 1010, in accordance with an embodiment. FIG. 11 is a perspective view of the spring clip 1010 illustrated in FIG. 10, in accordance with an embodiment. The spring clip 1010 includes a deflectable surface 1020 with an inclusion 1030 therein. The spring clip 1010 may be screwed or bolted to an intake manifold 1000 through the inclusion 1030.

While the above embodiment describe coupling a fuel rail to a cylinder head using a spring clip, one of ordinary skill in the art would recognize that other automotive components may be grounded using a similar system.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An engine, comprising:

a cylinder head configured to be ohmically coupled to a common ground;

a intake manifold configured to be coupled to the cylinder head, the intake manifold comprising an insulative material ohmically isolating the intake manifold from the cylinder head, the intake manifold including a first inclusion having a predetermined depth along a first surface of the intake manifold configured to be coupled to the cylinder head and a second inclusion having a predetermined depth on a second surface of the intake manifold, the second surface of the intake manifold being substantially perpendicular to the first surface of the intake manifold;

a fuel rail configured to be coupled to the intake manifold; and a spring clip configured to be ohmically coupled to the fuel rail, wherein the spring clip is further configured to be disposed within the first inclusion of the intake manifold and to have a deflectable surface having an undeflected depth greater than the predetermined depth of the first inclusion.

2. The engine of claim 1, wherein the spring clip is configured to be coupled to the intake manifold via a fastener.

3. The engine of claim 1, wherein the spring clip is configured to be coupled to the intake manifold via a second deflectable surface.

4. The engine of claim 3, wherein the spring clip is configured to be coupled to the intake manifold via the deflectable surface.

5. A vehicle, comprising:

an engine, comprising:

a cylinder head configured to be ohmically coupled to a common ground;

an intake manifold configured to be coupled to the cylinder head, the intake manifold comprising an insulative material ohmically isolating the intake manifold from the cylinder head, the intake manifold including an inclusion having a predetermined depth along a surface of the intake manifold configured to be coupled to the cylinder head;

a fuel rail configured to be coupled to the intake manifold; and a spring clip configured to be ohmically coupled to the fuel rail, wherein the spring clip is further configured to be disposed within the inclusion of the intake manifold and to have a deflectable surface having an undeflected depth greater than the predetermined depth of the inclusion.

6. The vehicle of claim 5, wherein the spring clip is configured to be coupled to the intake manifold via a fastener.

7. The vehicle of claim 5, wherein the spring clip is configured to be coupled to the intake manifold via a second deflectable surface.

8. The vehicle of claim 7, wherein the spring clip is configured to be coupled to the intake manifold via the deflectable surface.

9. The vehicle of claim 8, wherein the intake manifold comprises a second inclusion along a second surface of the intake manifold, the second surface being substantially perpendicular to the surface of the intake manifold configured to be coupled to the cylinder head.

10. An engine, comprising:

at least one cylinder head configured to be ohmically coupled to a common ground;

an intake manifold configured to be coupled to the at least one cylinder head, the intake manifold comprising an insulative material ohmically isolating the intake manifold from the least one cylinder head, the intake manifold including an inclusion having a predetermined depth along a surface of the intake manifold configured to be coupled to the least one cylinder head;

a fuel rail configured to be coupled to the intake manifold; and a spring clip configured to be ohmically coupled to the fuel rail, wherein the spring clip is further configured to be disposed within the inclusion of the intake manifold and to have a deflectable surface having an undeflected depth greater than the predetermined depth of the inclusion.

11. The engine of claim 10, wherein the deflectable surface comprises an arch.

12. The engine of claim 11, wherein the spring clip is configured to be coupled to the intake manifold via a fastener.

13. The engine of claim 12, wherein the spring clip is configured to be coupled to the fuel rail via a wire.

* * * * *